US006421011B1

(12) United States Patent
Van Egmond et al.

(10) Patent No.: US 6,421,011 B1
(45) **Date of Patent: *Jul. 16, 2002**

(54) PATCH ANTENNA USING NON-CONDUCTIVE FRAME

(75) Inventors: Maarten Van Egmond, Rijnsburg (NL); Keith V. Guinn, Basking Ridge; Stelios Papatheodorou, Morristown, both of NJ (US); Edward Bryan Roberts, Bath (GB); Ming-Ju Tsai, Livingston, NJ (US); Michael A. Zimmerman, North Andover, MA (US)

(73) Assignee: Lucent Technologies Inc., Murray Hill, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/425,374

(22) Filed: Oct. 22, 1999

(51) Int. Cl.[7] ..... H01Q 1/38
(52) U.S. Cl. ..... 343/700 MS; 343/872
(58) Field of Search ..... 343/700 MS, 872, 343/873, 829, 848, 846; H01Q 1/38

(56) References Cited

U.S. PATENT DOCUMENTS

| | | | | | |
|---|---|---|---|---|---|
| 5,614,915 | A | * | 3/1997 | Webb | 343/770 |
| 5,896,107 | A | * | 4/1999 | Huynh | 343/770 |
| 5,977,710 | A | * | 11/1999 | Kuramoto et al. | 343/700 MS |
| 6,008,763 | A | * | 12/1999 | Nystrom | 343/700 MS |
| 6,054,953 | A | * | 4/2000 | Lindmark | 343/700 MS |
| 6,118,405 | A | * | 9/2000 | Mckinnon et al. | 343/700 MS |
| 6,271,801 | B2 | * | 8/2001 | Tuttle et al. | 343/872 |

* cited by examiner

*Primary Examiner*—Don Wong
*Assistant Examiner*—Trinh Vo Dinh
(74) *Attorney, Agent, or Firm*—Christopher N. Malvone

(57) ABSTRACT

A non-conductive frame supports the resonators in a patch antenna assembly. The frame supports the resonators without making holes in the resonators and thereby avoids the problem of creating unwanted electric field polarizations. Additionally, the frame grasps the resonators in areas of low current density and thereby avoids creating additional disturbances in the radiation pattern. The frames may also include posts that are used to attach the frames to the feedboard without using additional components such as screws.

3 Claims, 4 Drawing Sheets

PATCH ANTENNA USING NON-CONDUCTIVE FRAME

CROSS REFERENCE TO RELATED INVENTIONS

This application is related to the following commonly assigned and concurrently filed U.S. patent applications entitled "Patch Antenna", Ser. No. 09/425,368; and "Patch Antenna Using Non-Conductive Thermo Form Frame", Ser. No. 09/425,373.

BACKGROUND OF THE INVENTION

1. Field of the Invention

The present invention relates to antennas; more particularly, patch antennas.

2. Description of the Prior Art

FIG. 1 illustrates an exploded view of a prior art patch antenna assembly. Non-conductive front housing 10 and conductive rear housing 12 form the outer surfaces of the antenna assembly. The two sections of the housing enclose multi-layered feedboard 14, resonators 16 and 18 and spacers 20. Spacers 20 are attached to front side 22 of feedboard 14 by screws 24. Screws 24 mate with threads on the inside of spacers 20 by passing through holes 26 in feedboard 14. Resonators 16 and 18 are attached to spacers 20 in a similar fashion. Screws 28 mate with threads on the inside of spacers 20 by passing through holes 30 in resonators 16 and 18. The spacers are chosen so that they provide a space of approximately 1/10 of a wavelength at the frequency of operation between feedboard 14 and resonators 16 and 18. The assembled feedboard, spacers and resonators are mounted inside of the enclosure formed by front housing 10 and rear housing 12. A signal to be transmitted by the antenna assembly is provided to conductor 40 of multi-layered feedboard 14. Conductor 40 is typically positioned on one layer of feedboard 14 such as on top layer 42. An insulating layer is typically provided between conductor 40 and a ground plane layer of feedboard 14. The ground plane layer 22 normally has openings or slots 44 which allow the signal from conductor 40 to couple to resonators 16 and 18 so that the signal can be transmitted through front housing 10.

FIG. 2 provides a more detailed illustration of the assembled feedboard 14, spacers 20 and resonators 16 and 18. Screws 24 pass through holes in feedboard 14 to mate with the threaded inside portion of spacer 20. Similarly, screws 28 pass through holes in resonators 16 and 18 to mate with the threaded inside portion of spacers 20.

This prior art patch antenna assembly suffers from several shortcomings. The assembly is expensive to assemble because of the many individual parts such as eight spacers and 16 screws. The spacers are expensive to mass produce because they include threaded inner portions. Additionally, the holes made through resonators 16 and 18 to allow screws 28 to mate with spacers 20 create unwanted patterns in the radio frequency energy radiated by the antenna assembly. For example, if the antenna is being used for a horizontally polarized transmission, the holes introduce additional non-horizontal polarizations in the transmitted signal.

SUMMARY OF THE INVENTION

The present invention solves the aforementioned problems by providing a non-conductive frame that supports the resonators. The frame supports the resonators without making holes in the resonators and thereby avoids the problem of creating unwanted electric field polarizations. Additionally, the frame grasps the resonators in areas of low current density and thereby avoids creating additional disturbances in the radiation pattern. In another embodiment of the invention, the frames include posts that are used to attach the frames to the feedboard without using additional components such as screws.

DETAILED DESCRIPTION OF THE INVENTION

Figure 3:
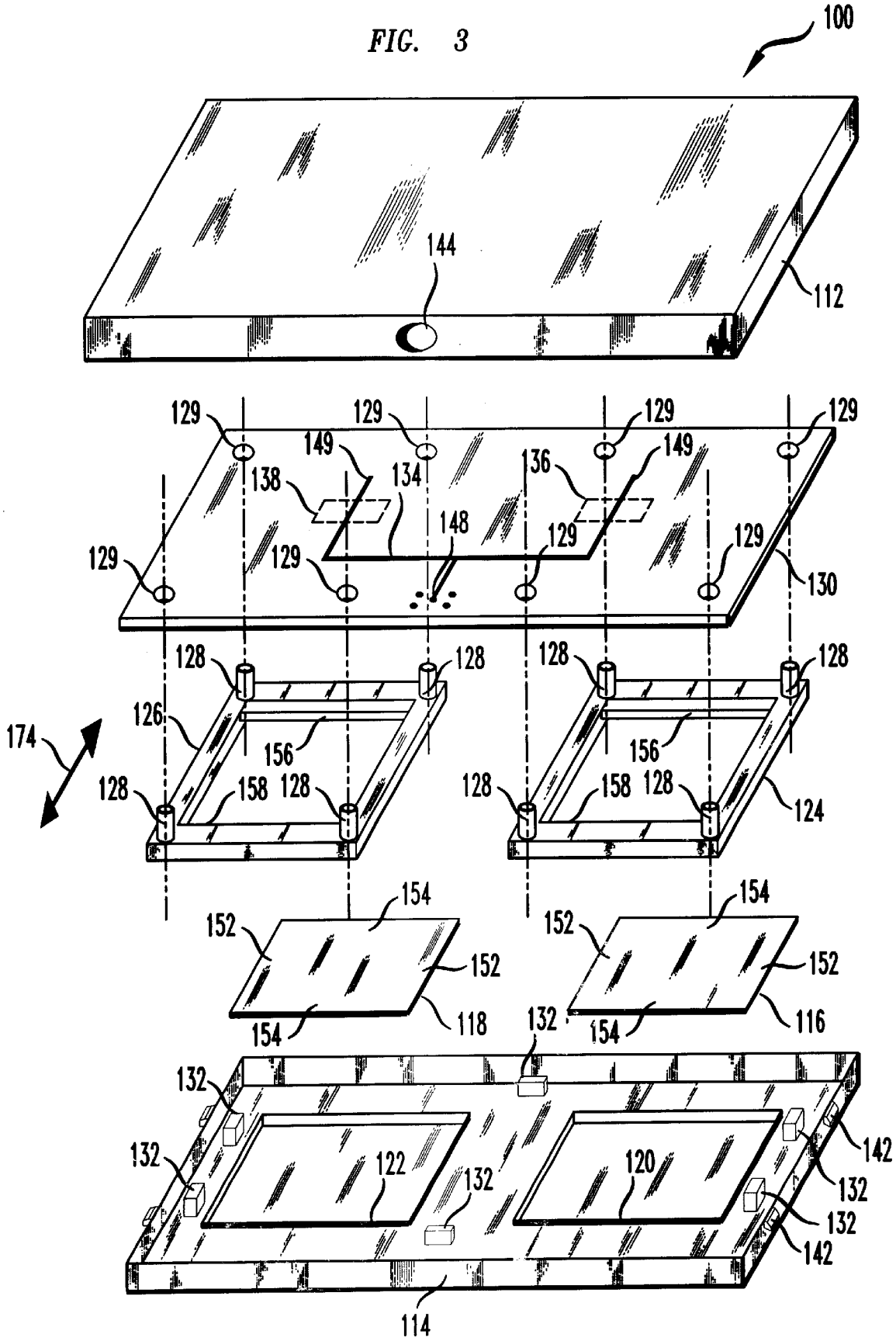
FIG. 3 illustrates an exploded view of a patch antenna assembly having non-conductive frames.

FIG. 3 illustrates patch antenna assembly 100. The assembly is enclosed by conductive rear housing section 112 and non-conductive front housing section 114. Resonator elements 116 and 118 are held in non-conductive frames 124 and 126, respectively. Posts 128 of the non-conductive frames are received by post holes 129 of feedboard 130. Feedboard 130 is positioned in front housing section 114 by positioning tabs 132. Feedboard 130 is multilayered and contains a ground plane, a plane containing conductor 134, and insulating layers on the top and bottom surfaces and between conductor 134 and the ground plane. Slots 136 and 138 in the ground plane permit a radio frequency (RF) signal on conductor 134 to couple to resonators 116 and 118 so that RF energy may be transmitted through front housing section 114. Rear housing section 112 then mates with front housing section 114 and locks in place by interacting with locking tabs 142. Rear section 112 contains opening 144 which provides a passage through which a conductor can pass for attachment to point 148 on conductor 134.

Non-conductive frames 124 and 126 include posts 128. It should be noted that frames 124 and 126 may be manufactured using injection molding and may also be formed as one part rather than two in order to simplify assembly. Post holes 129 in feedboard 130 receive posts 128. The frames may be held in place by melting the portion of post 128 that extends through feedboard 130 to form a mushroom cap that holds the frames in place. Resonators 116 and 118 are snapped into frames 124 and 126, respectively. The frames hold resonators 116 and 118 approximately 1/10 of a wavelength at the frequency of operation away from feedboard 130. Front housing section 114 includes tabs 132 that assist in the alignment or placement of feedboard 130 into front housing section 114. If the frames and resonators are placed into front housing section 114 before they are attached to feedboard 130, ridges 120 and 122 assist in the alignment or placement of the frames and resonators. It should be noted that guide ridges 120 and 122 do not extend higher than non-conductive frames 124 and 126 to ensure that ridges 120 and 122 do not interfere with the 1/10 wavelength spacing provided by the non-conductive frames.

Figure 1:
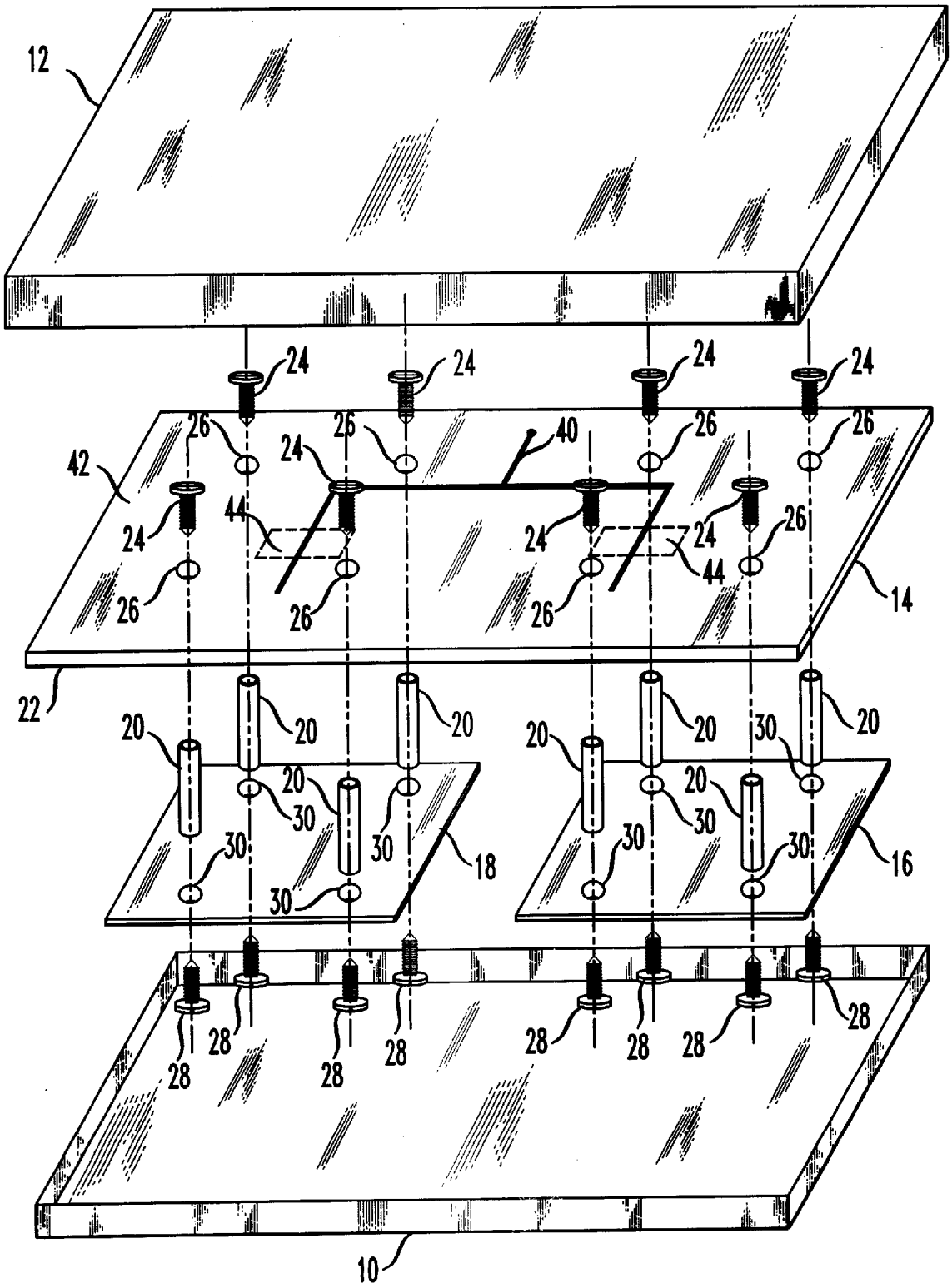
FIG. 1 PRIOR ART
FIG. 1 illustrates a prior art patch antenna assembly.
Figure 2:
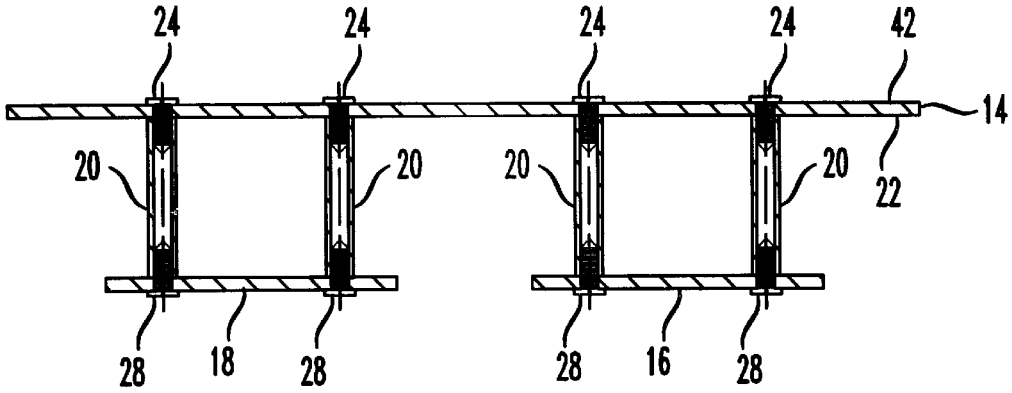
FIG. 2 PRIOR ART
FIG. 2 illustrates a prior art feedboard, spacer and resonator assembly.
Figure 4:
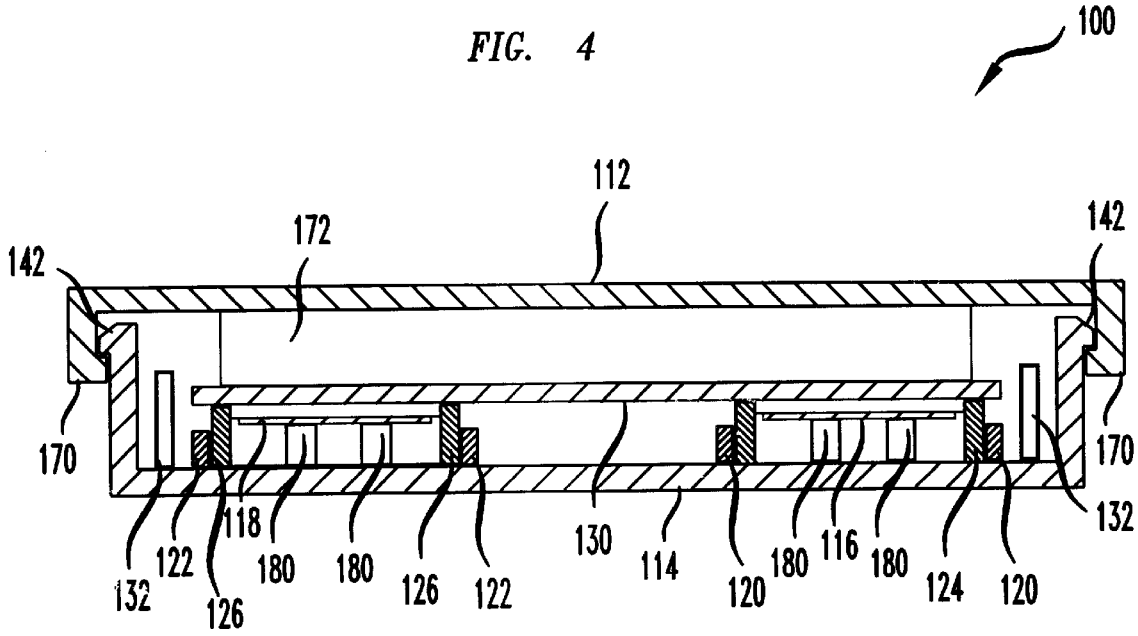
FIG. 4 illustrates a cross section of an assembled patch antenna system having non-conductive frames.

FIG. 4 illustrates a cross section of antenna assembly 100. Interlocking tabs 142 and 170 hold front housing sections 114 and 112 together. Resonators 116 and 118 are supported in frames 124 and 128, respectively. Retention tabs 180 hold the resonators in their respective frames. As mentioned earlier, the frames may be attached to feedboard 130 using posts 128; however, it is also possible to maintain the relationship between the frames and feedboard using a compression force provided by rib 172 of rear housing section 112. The placement of the frames in front housing section 114 is facilitated by guide ridges 120 and 122. Placement of feedboard 130 is facilitated by placement tabs 132. Rear housing section 112 includes a series of parallel ribs 172. When sections 114 and 112 are interlocked using tabs 170 and 142, ribs 172 press down on the components beneath them so that the components are effectively compressed between ribs 172 and the inner surface of front housing section 114.

In reference to FIG. 3, it should be noted that the radio frequency (RF) signal on conductor 134 couples to the resonators through sections 149 of conductor 134 which pass over slots 136 and 138. The desired dominant polarization direction 174 is shown. When the RF signal couples to the resonators, the higher current densities on the resonators occur on the sides of the resonators that are parallel to conductor sections 149. As a result, side sections 152 of resonators 116 and 118 contain the higher current densities. In order to limit interfering with the higher current densities, it is desirable that frames 124 and 126 minimize contact with the resonators along side sections 152. In order to minimize this contact, frames 124 and 126 make contact with the resonators along perimeter surfaces 154 using retention tabs and support surfaces or ridges positioned along frame sides 156 and 158.

Figure 5:
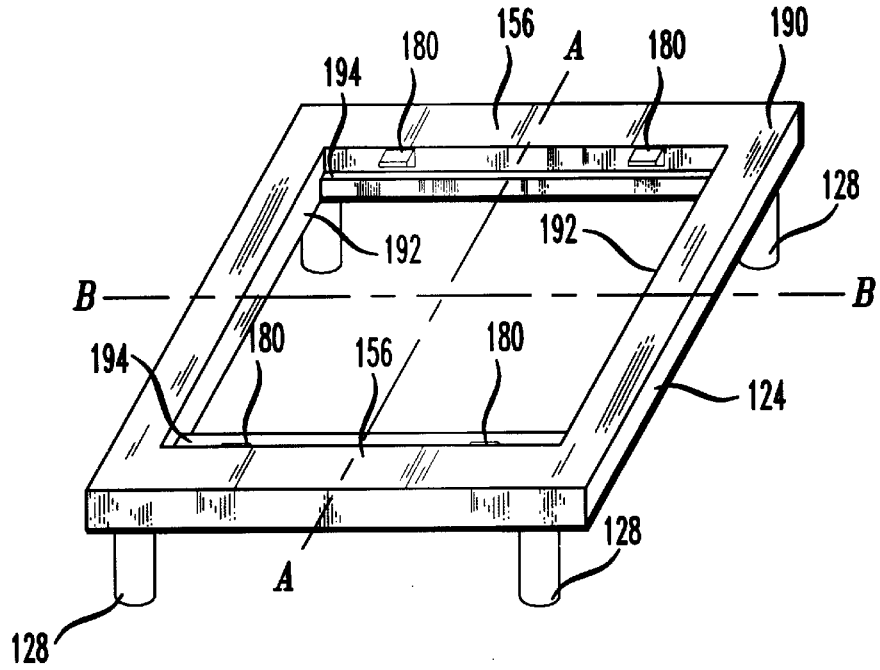
FIG. 5 illustrates a non-conductive frame.

FIG. 5 illustrates frame 124. It should be noted that frames 124 and 126 are identical and may be formed in one piece by using ribs that interconnect the two frames. The frames may be fabricated using a material such as a polycarbonate or Noryl® type plastic. (Noryl® is a registered trademark of General Electric Company.) In general, the material should have a low dielectric loss tangent. Frame surface 190 faces in the direction of the inner surface of front housing section 114 when the patch antenna assembly is constructed. Posts 128 are received in holes 129 of feedboard 130. It should be noted that posts 128 may be inserted through the receiving holes of feedboard 130 and then heated to create a mushroom-type cap that will hold the frame in place. It is desirable that frame sides 192 do not contact the resonator because the higher current densities on the resonator occur along surfaces adjacent to these edges and contacting the high current density surfaces will interfere with the resulting radiation pattern. In general, the frame should not contact the resonator along edges that are parallel to the conductor that couples the RF signal to the resonator or along surfaces that are adjacent to those edges. Sides 156 of frame 124 include retention tabs 180 and support surface 194. The resonator is inserted into the frame by pressing the resonator past retention tabs 180 so that the edges of the resonator are supported by surface 194 and are held against or adjacent to surface 194 by tabs 180.

Figure 6:
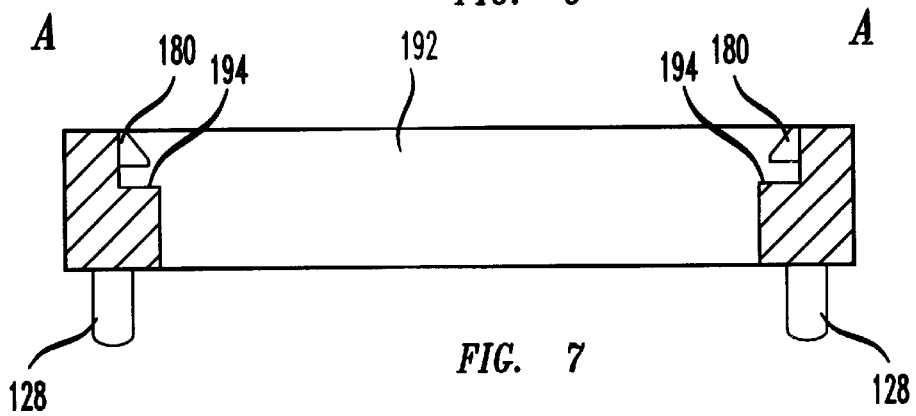
FIG. 6 is a cross section of the frame of FIG. 5 along line A—A.

FIG. 6 is a cross section of the frame of FIG. 5 along line A—A. The figure illustrates posts 128, retention tabs 180 and resonator support surfaces 194.

Figure 7:
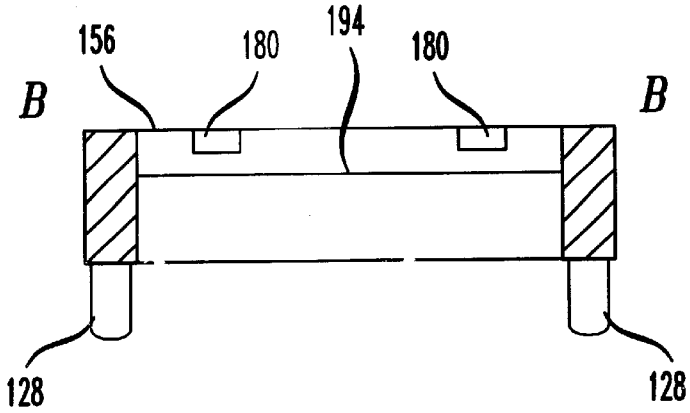
FIG. 7 is a cross section of the frame of FIG. 5 along line B—B.

FIG. 7 is a cross section of the frame of FIG. 5 along line B—B. Posts 128 are illustrated along with tabs 180 and support surface 194.

The invention claimed is:

1. An antenna assembly, comprising:

a signal feedboard having a ground plane with an opening and a signal conductor positioned across the opening;

a resonator having a planar surface; and a nonconductive frame contacting the resonator with the planar surface facing the opening and with the planar surface being substantially parallel to the signal feedboard, wherein the nonconductive frame contacts the resonator along at least a portion of a perimeter of the planar surface.

2. An antenna assembly, comprising:

a signal feedboard having a ground plane with an opening and a signal conductor positioned across the opening;

a resonator having a planar surface; and a nonconductive frame contacting the resonator with the planar surface facing the opening and with the planar surface being substantially parallel to the signal feedboard, wherein the nonconductive frame contacts the resonator along a portion of a perimeter of the planar surface, where the portion of the perimeter supported by the frame is in an area of relative low current density with respect to other portions of the perimeter of the planar surface.

3. An antenna assembly, comprising:

a signal feedboard having a ground plane with an opening and a signal conductor positioned across the opening;

a resonator having a planar surface; and a nonconductive frame contacting the resonator with the planar surface facing the opening and with the planar surface being substantially parallel to the signal feedboard, wherein the nonconductive frame contacts the resonator along a portion of a perimeter of the planar surface, where the portion of the perimeter supported by the frame is adjacent to an edge that is substantially non-parallel to the signal conductor.

* * * * *